US008528837B2

(12) United States Patent
Kwasny

(10) Patent No.: US 8,528,837 B2
(45) Date of Patent: Sep. 10, 2013

(54) AEROSOL CAN

(75) Inventor: Peter Kwasny, Gundelsheim (DE)

(73) Assignee: Peter Kwasny GmbH (CH)

( * ) Notice: Subject to any disclaimer, the term of this patent is extended or adjusted under 35 U.S.C. 154(b) by 961 days.

(21) Appl. No.: 10/580,865

(22) PCT Filed: Nov. 17, 2003

(86) PCT No.: PCT/EP03/12843

§ 371 (c)(1),
(2), (4) Date: Mar. 16, 2007

(87) PCT Pub. No.: WO2005/051802

PCT Pub. Date: Jun. 9, 2005

(65) Prior Publication Data

US 2007/0272765 A1 Nov. 29, 2007

(51) Int. Cl.
*B05B 7/32* (2006.01)

(52) U.S. Cl.
USPC ..... 239/337; 239/541; 239/581.1; 239/583; 222/402.13; 222/548; 222/554

(58) Field of Classification Search
USPC ..... 239/337–339, 340, 581.1, 581.2, 239/582.1, 525, 526, 537, 538, 539, 541, 239/583; 222/402.1, 402.11, 402.13, 544, 222/547, 548, 554
See application file for complete search history.

(56) References Cited

U.S. PATENT DOCUMENTS

| | | | | | |
|---|---|---|---|---|---|
| 248,555 | A | * | 10/1881 | Clarke | 251/155 |
| 1,214,971 | A | * | 2/1917 | Tibbals | 222/547 |
| 3,176,888 | A | | 4/1965 | Focht | |
| 3,393,844 | A | * | 7/1968 | Beres et al. | 222/533 |
| 3,407,977 | A | | 10/1968 | Ruggeri | |
| 3,648,932 | A | | 3/1972 | Ewald et al. | |
| 3,711,030 | A | | 1/1973 | Jones | |
| 3,863,816 | A | | 2/1975 | Focht | |
| 3,961,756 | A | * | 6/1976 | Martini | 239/337 |
| 6,027,042 | A | | 2/2000 | Smith | |
| 7,017,785 | B2 | | 3/2006 | Lasserre et al. | |

* cited by examiner

*Primary Examiner* — Christopher Kim
(74) *Attorney, Agent, or Firm* — Berliner & Associates

(57) ABSTRACT

The invention relates to an aerosol can comprising a body containing a propellant and an aerosol product, a valve whose actuation enables said aerosol product to be sprayed, and a spray head (1) which serves to discharge the aerosol product to the environment when the valve is actuated. The spray product discharge rate of the inventive aerosol can is adjustable by means of an adjusting device provided in the spray head (1). Said invention can primarily be used for aerosol paint cans in view of the fact that for such applications a controlled and uniform discharge rate is of particular importance in order to avoid painting defects.

2 Claims, 4 Drawing Sheets

AEROSOL CAN

The invention relates to an aerosol can comprising a body containing a propellant and an aerosol product, a valve whose actuation enables said aerosol product to be sprayed, and a spray head which serves to discharge the aerosol product to the environment when the valve is actuated, said spray head being provided with an axial borehole through which the aerosol product enters the spray head. The invention also relates to a spray head to be used as part of the inventive aerosol can.

In various fields of application aerosol cans have been in widespread use for many years. Aside from a great variety of other aerosol products also paint material is sold in pressurized aerosol paint cans which enjoy great popularity especially in the do-it-yourself business because aerosol paint cans are a rather simple and cost-efficient method of applying paint material in comparison to the clearly more sophisticated compressed air, airless or other paint spraying equipment and systems. However, in comparison to the latter aerosol paint cans suffer the disadvantage that the user is unable to freely determine the discharge rate of the paint. Conventional aerosol cans have a discharge rate of approx. 10 g within a time span of 10 seconds but EP 0 925 236 B1 also has disclosed aerosol cans having a discharge rate of up to 35 g/10 s.

However, more often than not it will certainly be desirable for the user to decrease or increase the paint discharge rate in a simple manner. In this context a high discharge rate will as a rule be useful if larger surfaces are to be uniformly coated but for the painting of smaller surfaces or when more intricate painting jobs are to be carried out it may be desirable to keep the discharge rate as low as possible so as to gain better control over the painting operation in this way. Although such a paint discharge rate control is basically possible to a certain degree by pressing the spray head arranged on the top end of the aerosol can down more or less vigorously it is doubtlessly extremely inaccurate and may therefore cause the results of the painting work to deteriorate considerably. Aside from paint spraying there are further fields of use where control or regulating features are desirable. Bearing the above in mind there is need for the provision of an aerosol can that enables the discharge rate to be regulated in a most simple manner without having to resort to a considerably more sophisticated and expensive spraying method.

According to the invention this objective is reached by providing an aerosol can 40 comprising a body 38 containing a propellant as well as an aerosol product 39, a valve whose actuation enables said aerosol product to be sprayed, and a spray head which serves to discharge the aerosol product to the environment when the valve is actuated, said spray head having an axial borehole through which the aerosol product enters the spray head, and being provided with an additional adjustment device for the discharge rate to be regulated.

Such an aerosol can allows the use of a conventional can body and a conventional valve so that merely the respective adjustment device has to be arranged in the spray head. Since the spray head is a particularly small and inexpensive component of the aerosol can the entire aerosol can according to the invention can be manufactured in a particularly cost-effective way. As it is the spray head of the aerosol can that the user actuates when discharging the aerosol product the discharge rate can be easily manipulated and controlled even by inexperienced persons with the help of the aerosol can according to the invention.

Various design variants are conceivable in order to mount the adjusting device in the spray head. In accordance with a preferred embodiment of the invention the spray head thus has an adjusting device in the form of an adjustable needle valve used for the regulation of the discharge rate. Between the axial bore in the spray head and the outlet of the spray head a gap, preferably an annular gap, is provided into which the tapered end of the needle valve projects thus closing it off to a varying degree depending on how deeply it enters the gap. Via the aforementioned gap a connection is created between the outlet and the axial bore so that the connection between axial bore and outlet will open if the needle valve has been unscrewed to great the extent. Expediently, the needle valve is provided with a thread and can be adjusted from the outside.

If the needle valve is screwed down fully the gap between outlet and axial bore is completely or almost completely closed off so that the discharge rate is very low or even zero whereas higher discharge rates are attained if the needle valve is unscrewed to a great extent thus opening the gap widely. To enable the needle valve to be more easily manipulated a small wheel or other handle is advantageously arranged on its outer end. Since the spray head is a very small component all other dimensions have to be suitably determined as well. For example, the diameter of the annular gap serving pre-dosing purposes is typically in the range of 1.5 mm whereas the thread of the needle valve may have a size of approx. 2.3 mm. The tip of the tapered end of the needle valve may be sloped at an angle of approx. 20°. Depending on other properties of the aerosol can, i.e. particularly the rate of the pressure exerted by the propellant and the specific design of the spray head and valve, the discharge rate can be steplessly varied between approx. 0 and 31 g/10 s. Of course, the figures indicated here are only examples and shall in no way limit the range and scope of the invention.

The needle valve may be provided transversely to or along the axis of the axial borehole located in the spray head. In the event of a transversely located needle valve the gap will be arranged on the inside of the spray head outlet so that the tapered end of the needle valve enters the gap sideways. In this manner the needle valve does not interfere with the actuating face of the spray head onto which the user must exert pressure when spraying with the aerosol can so that this arrangement constitutes a preferred embodiment of the invention.

It is nevertheless also possible to have the needle valve arranged longitudinally with the axial bore so that it adjustment end projects from the actuating face of the aerosol can. In this case the gap into which the cone of the needle valve moves is located on the upper end of the axial bore.

In accordance with an alternative embodiment the spray head is equipped with a tubular element with openings on both ends, said element being provided with the outlet of the spray head on one end and movably arranged in a recess provided for this purpose in the spray head such that a tapered element located in the axial bore adjustably engages with the inner opening of said tubular element and in this manner regulates the passage available to the aerosol product to be sprayed. The tip of the tapered element points in the direction of the outlet. Depending on how far the tubular element is moved in the direction of the tapered element the clearance between the end of the tubular element and the tapered element varies in size so that varying amounts of the aerosol product can be discharged within a certain time span. The function of the tapered element of this embodiment thus corresponds to that of the cone of the needle valve of the embodiment described hereinbefore but with the exception that in this case it is not the cone that is moved towards a stationary gap but, instead, the tubular element provided with the outlet is moved towards the stationary tapered element.

To make the invention easier manageable for the user additional gripping elements are expediently provided on the outside of the tubular element which enable the tubular element to be moved out of or into the spray head. To enable this movement to be better controlled and thus enable the discharge rate of the aerosol product to be effectively regulated it is advantageous to design the tubular element such that it can be threaded into the spray head for which purpose it is provided with a male thread whereas the opening accommodating the tubular element having a matching female thread. In this manner it is particularly easy to screw the tubular element into the spray head towards the tapered element or unscrew it thus moving it out of the spray head and away from the tapered element. The farther the tubular element is moved out the higher the discharge rate of the aerosol product. Alternatively, additional embodiments are of course conceivable which provide for the tubular element to be pushed into the spray head along or through guides provided in the head's opening for this purpose.

In accordance with another alternative embodiment the spray head has a lateral borehole arranged transversely to and being connected with the axial bore with the outlet of the spray head being located at one end of the lateral bore and a rotatable cylinder-shaped element projecting into this lateral bore from the other end of it, said latter element extending over the axial borehole to a minor extent. On at least one side the cylinder-shaped element has a bevel or rounding, for example in the form of a non-symmetrical cone, which enables a flow passage to be cleared extending from the axial to the lateral borehole if said bevel or rounding portion is positioned over the axial bore by suitably turning the cylinder-shaped element. Rotating or turning the cylinder-shaped element thus causes a non-rounded portion to be positioned over the axial bore which in this manner may be covered quasi entirely if so desired. The bevel or rounding located on one end of the cylindrical element is shaped in such a manner that the discharge rate may be regulated in a virtually infinitely variable manner with the maximum discharge rate being attained if the maximum portion of the bevel or rounding is positioned over the axial bore whereas the minimum discharge rate, respectively complete closure is achieved when a non-beveled or non-rounded portion of the cylindrical element is moved over and thus covers the axial bore. In order to achieve this, the bevel or rounding around the cylindrical element is shaped in such a way that the degree of bevel or rounding increases or decreases continuously. Expediently, the cylindrical element has a maximum rounding or bevel on one side while it is completely straight on its opposite side which makes sure an adjustment from the maximum to the minimum opening is brought about by turning the element by 180°. One end of the cylindrical element projects from the spray head on one side, typically on the side opposite the outlet, so that the user may seize and manipulate this end by turning it as required to obtain the desired discharge rate. For ease of use also a handle may be provided on this end of the cylindrical element. Moreover, it is considered expedient to provide on the spray head a simple indicating device, for example an indicating element on the cylindrical element connected with a scale on the spray head proper with such scale providing precise information about the discharge rate, if applicable.

Another alternative embodiment aimed at creating the adjustment device in the spray head according to the invention provides for the arrangement of a lateral bore in the spray head located transversely to and being connected with the axial bore, said lateral bore being closed off on one end and accommodating a movably inserted tubular element open on both ends and having the outlet of the spray head located on one end, and with said tubular element in inserted state being positioned over the axial bore and, on its end covering the axial bore, provided with a bevel or rounding that reduces the cross-sectional area of the tubular element in the direction of the closed end of the lateral bore, with the axial bore being provided with a shoulder at the side of and extending into the closed-off end of the lateral bore, said shoulder or projection being adjacent to the bevel or rounding of the tubular element so that depending on how far the tubular element is inserted into the lateral bore a flow passage of variable size is created between the bevel or rounding and the projection with said passage forming a connection between the axial bore and the inner opening of the tubular element.

In this case a channel extends through the tubular element and terminates at the end of the lateral bore in the spray head when the tubular element is inserted into the spray head. This end of the lateral bore is isolated from the axial bore entirely or almost entirely when the tubular element is inserted to a maximum extent into the spray head since the edge-forming shoulder or projection located at the end of the axial bore and at the side of the closed end of the lateral bore is thus positioned adjacent to the bevel or rounding provided on the tubular element. However, if the tubular element is retracted from the spray head the bevel or rounding of the tubular element moves away from said edge resulting in the cross-sectional area of the flow passage to increase more and more. When the flow passage has been fully cleared there is a direct connection between axial bore, flow passage, inner end of the lateral bore and channel in the tubular element so that the aerosol product can be discharged when the valve is actuated. With the tubular element being inserted fully the discharge rate will be lowest and increase as soon as the tubular element is moved out of the spray head.

In this case as well the tubular element can be of either slide-in or screw-in design for mounting into the lateral bore. In the event of a screw-in type tubular element the element will have a male and the lateral bore a matching female thread configuration. In this case, however, the thread and the degree of movability of the tubular element must be tailored to the bevel or rounding portion at the end of the tubular element in such a way that said element is always positioned over the end of the axial bore to make sure the flow passage size can be adjusted as necessary. To achieve this it may be useful to provide for the bevel at the end of the tubular element to extend at least partially along the circumference of the tubular element.

Another embodiment of the invention comprises an aerosol can equipped with a rotatable or shiftable element having one or several openings that can be positioned in front of or into the outlet of the spray head. To enable the discharge rate to be regulated in this manner the rotatable or shiftable element has several openings of different cross section. The respective opening positioned in front of or into the outlet of the spray head will govern the discharge rate. For example, the rotatable or shiftable element may be provided with an opening having a diameter of 0.3 mm and another opening 0.5 mm in diameter so that the discharge rate will increase accordingly when the 0.5 mm opening is used. The openings may also be of different configuration or shape in that different nozzle types are provided, for example a circular nozzle or fan nozzle.

Compared to the embodiments described hereinbefore this embodiment offers the advantage that its design is less sophisticated and complex. On the other hand, it is no longer possible to have an infinitely variable discharge rate adjustment capability when different openings of varying cross section are provided in the rotatable or shiftable element but said rate can merely be varied in certain steps with the number of said steps always depending on the number of openings having different cross sections.

Aside from this, the openings in the rotatable or shiftable element may also be designed such that their cross sectional areas vary depending on whether they are positioned in front of or within the outlet. Slotted openings are, for example, conceivable with the respective slots widening from one end to the other. If now the widest free area of the slot is positioned in front of or within the outlet of the spray head a maximum discharge rate is attained. Providing the rotatable or shiftable element with openings having variable cross sections enables the discharge rate to be steplessly adjusted and is thus considered to offer significant advantages. If so desired, several openings of different cross sectional areas may be combined with openings having variable cross sections so that for example an opening may be available for discharge rates from 0 to 16 g/10 s and a second opening of variable cross section for a discharge rate ranging from 16 to 31 g/10 s.

In accordance with another embodiment of the invention an elastic element, for example made of rubber, is arranged in the spray head in contact with the axial bore so that force can be exerted on said elastic element which as a result of this is compressed along the axial bore and in this way reduces its cross section in this direction. At the same time the cross section of the elastic element increases transversely to the axial bore because it is not possible or very difficult to compress said element which for that reason is deformed and thus moves into the direction where no resistance is encountered. As a result of the force thus exerted the elastic element expands towards the axial bore. In this manner the elastic element moves at least partially into the cross sectional area of the axial bore which thus narrows causing the discharge rate to be reduced.

Advantageously, the elastic element is of circular shape and placed around the axial bore for which purpose said elastic element also has been provided with an inner hole. The circular elastic element is fitted into the spray head in such a way that the axial bore of the spray head and the hole in the elastic element are positioned one above the other. Exerting an axial force will now cause the elastic element to be correspondingly compressed over its entire circumference and widened transversely to the axial bore so that the diameter of the hole provided in the elastic element becomes constricted resulting in the discharge rate of the aerosol product to be sprayed to diminish accordingly.

To make it particularly easy for the user to exert an axial force on the elastic element the spray head may be of two-part design consisting of a top and a bottom portion. The elastic element in this case is fitted into the space existing between the top part and bottom part in such a manner that said elastic element is compressed in axial direction as soon as the top part and the bottom part are moved towards each other. This compressive force now acting on the elastic element will simultaneously cause the element to move in the direction of the axial bore which as a result will become constricted accordingly. Particularly, the elastic element used may again be of circular shape so that when top part and bottom part are moved against each other the diameter of the hole provided in the elastic element will become constricted. As an alternative to designing the spray head comprising a top part and a bottom part it is basically also possible to make use of other constructive elements for this purpose, such as for example a stamp, by means of which the elastic element can be compressed.

Preferably, the top part and bottom part of the spray head can be moved against each other by joining them with the aid of a threaded connection. In this way, top part and bottom part can be rotated against each other resulting in decreasing or increasing the clearance between them so that the elastic element is appropriately compressed or decompressed. Therefore, performing a rotating movement relative to the top part and bottom part of the spray head will thus enable the discharge rate of the spray head to be regulated. Adjusting the discharge rate by performing a rotating movement will also be especially beneficial in that the user may initially adjust the spray head to meet his or her needs and subsequently operate the aerosol can in the known manner by exerting pressure on the top side of the spray head. Since the adjustment of the discharge rate and the actuation of the spray head require completely different movements to be performed that are orthogonal to each other it is not to be feared basically that the set discharge rate may become maladjusted when the spray head is pressed down. As an alternative and in lieu of connecting the top and bottom part of the spray head via a thread it is of course also possible to provide a separate element with a thread with said element being screwed into the spray head thus causing the elastic element to be compressed.

The aerosol can according to the invention is of particular importance in the field of pressurized aerosol paint cans where the aerosol product to be sprayed is a varnish, a painting preparation agent or other coloring substance. The aspect of special significance in this field of use as referred to above is due to the requirement that painting in particular calls for a uniform and controlled spraying performance. Basically, however, the invention applies to and is to be used for all types of aerosol cans.

Aside from the aerosol can according to the invention the invention also relates to the spray head to be used as part of an aerosol can of the kind described hereinbefore.

Basically, it will also be possible to combine different embodiments of the invention. For example, when a needle valve is used to control the discharge rate a rotatable or shiftable element that has various openings of different size may additionally be employed and mounted in front of the outlet.

Further elucidation of the invention is provided through the enclosed figures, where FIG. 1 is a cross-sectional representation of a spray head according to the invention as a first embodiment;

Figure 1:
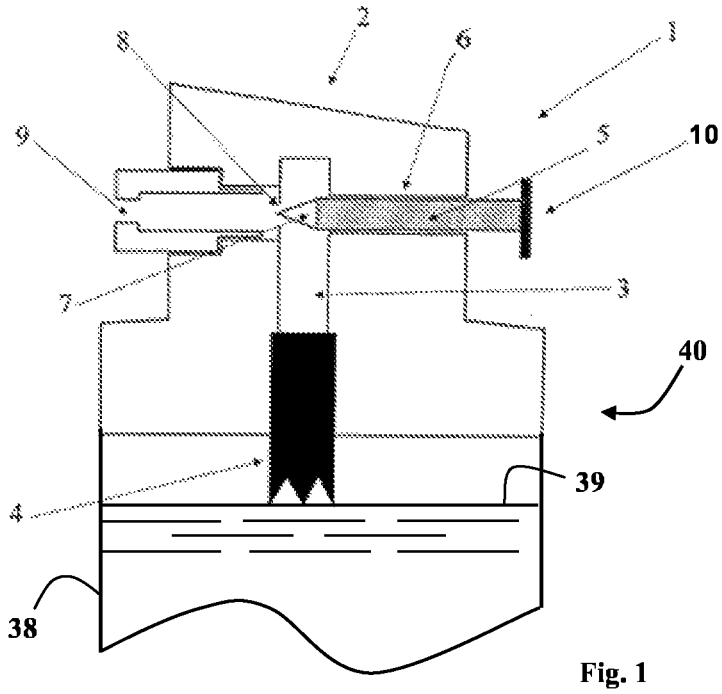

FIG. 1 shows a spray head 1 according to the invention and as a first embodiment which for the control of the discharge rate makes use of a needle valve 5. Spray head 1 constitutes the upper end of an aerosol can (not shown in the figure) with spray head 1 being connected via axial bore 3 with valve 4 and the body of the can. Valve 4 is opened by exerting pressure onto the top side 2 of spray head 1 which causes the propellant to transfer the aerosol product through valve 4 into the spray head 1. Axial bore 3 is connected with the outlet 9 via a gap 8 of annular shape so that the aerosol product is permitted to be discharged.

To enable the discharge rate to be controlled the spray head 1 is provided with a recess 6 located transversely to axial bore 3 said recess or opening accommodating a needle 5 the pointed end of which has been provided with a cone 7. Such cone 7 terminates in gap 8 and closes this off as desired completely or to a greater or lesser extent. Needle 5 has a thread and may be screwed in as far as required making use of handle 10. With the needle screwed in fully the gap 8 is closed off to a large extent because cone 7 is positioned adjacent to gap 8 resulting in the connection between outlet 9 and axial bore 3 to be interrupted. If needle 5 is now unscrewed and thus further moved out of spray head 1 the clearance between gap 8 and cone 7 of needle 5 increases so that correspondingly greater volumes of aerosol product are allowed to be liberated. Particularly fine dosing results can be achieved with the help of such a needle valve 5.

Figure 2:
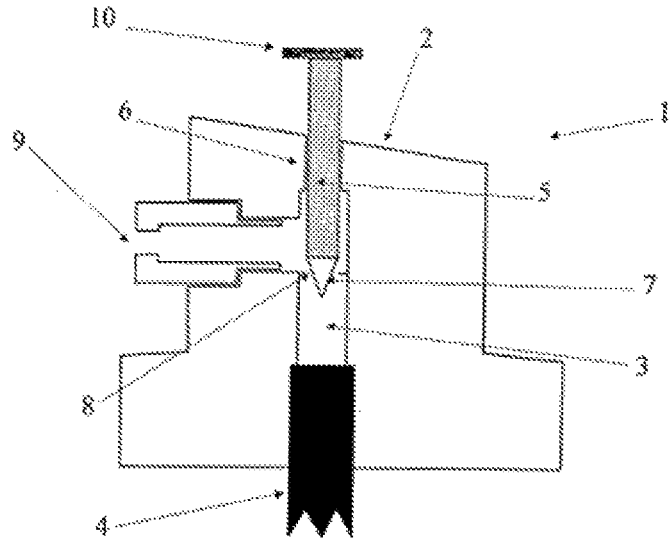
FIG. 2 is a cross-sectional representation of a spray head according to the invention as a second embodiment.

FIG. 2 represents a variant of the embodiment shown in FIG. 1 which provides for the control of the discharge rate to be achieved with the aid of a needle valve 5. FIG. 2 differs from FIG. 1 to the extent that the gap 8 in this case is located at the upper end of axial bore 3 and the cone 7 of needle 5 enters gap 8 from above. In this case as well gap 8 is largely closed off by screwing in needle 5 so that the discharge rate decreases accordingly whereas unscrewing and moving needle 5 out will result in the discharge rate to go up due to the fact that the passage between gap 8 and cone 7 is increasingly cleared.

Figure 3:
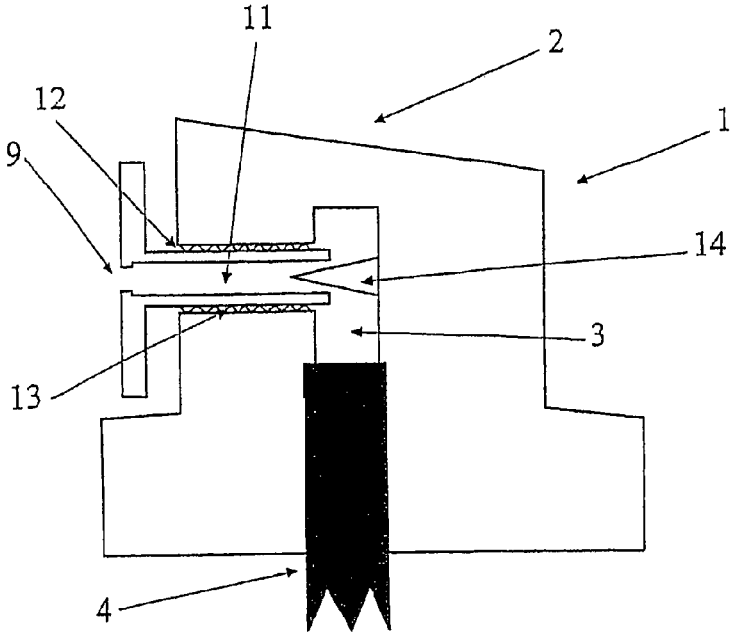
FIG. 3 is a cross-sectional representation of a spray head according to the invention as a third embodiment.

FIG. 3 shows an alternative embodiment of the invention that also provides for the regulation of the discharge rate to be achieved through a movement relative to a tapered element. However, other than with the embodiments shown in FIG. 1 and FIG. 2 the tapered element 14 in this case is arranged stationary in the area of axial bore 3 with a tubular element 11 being provided which is movable in the direction of tapered element 14. The tubular element 11 is moved through the recess 12 provided in spray head 1 with the help of thread 13. The farther tubular element 11 is screwed into spray head 1 the smaller the clearance between tapered element 14 and the inner end of tubular element 11 resulting in the discharge rate of the aerosol product to diminish accordingly. On the other hand, the flow passage increases vice versa and the discharge rate rises accordingly when tubular element 11 is unscrewed.

Figure 4:
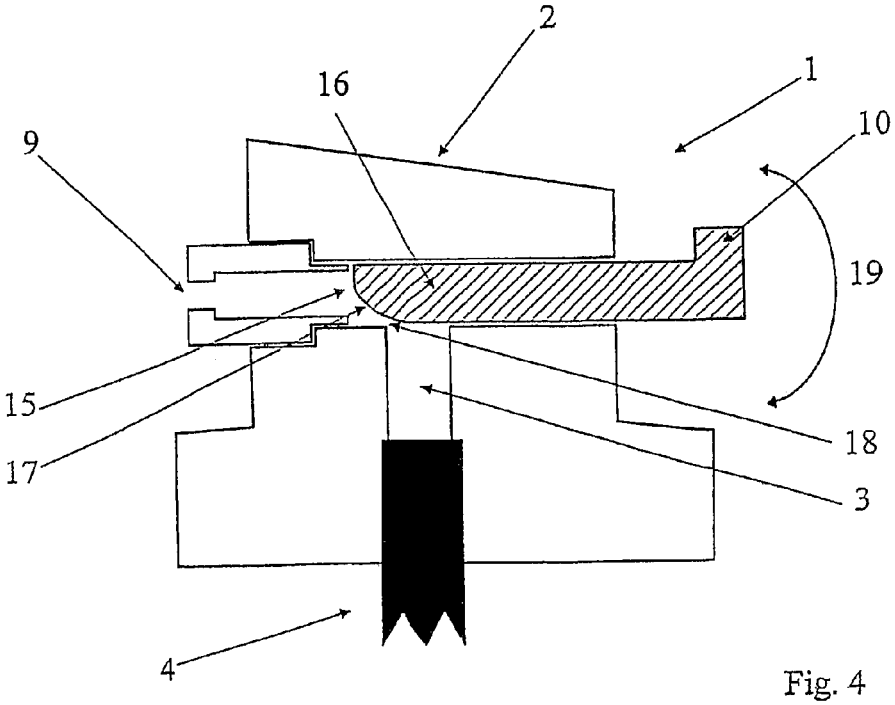
FIG. 4 is a cross-sectional representation of a spray head according to the invention as a fourth embodiment.

In the embodiment of the invention as shown in FIG. 4 the spray head has been provided with a lateral bore 15 arranged transversely to axial bore 3, said lateral bore being connected to axial bore 3. From the side opposite outlet 9 a cylindrical element 16 is inserted into lateral bore 15 said element extending into and overlapping axial bore 3. The inner end of cylindrical element 16 is shaped in the form of a non-symmetrical cone 17 which when positioned over axial bore 3 clears a flow passage 18 said passage forming the connection between axial bore 3, lateral bore 15 and outlet 9. In this position the aerosol product is allowed to exit as appropriate. Cylindrical element 16 can be rotated in lateral bore 15 as indicated by arrow 19 with, after a 180° turn, the non-rounded inner end of cylindrical element 16 being positioned over axial bore 3 thus closing this bore off. In this position the discharge rate will diminish accordingly. Aside from the maximum and minimum positions referred to above various further settings are conceivable so that a quasi stepless discharge rate adjustment can be achieved. For this purpose the rounding/bevel circumferentially provided around the cylindrical element 16 is designed such that the bevel/rounding increases constantly from one side to the opposite side until the maximum flow passage size 18 has been reached as shown for the position indicated in the figure.

Figure 5:
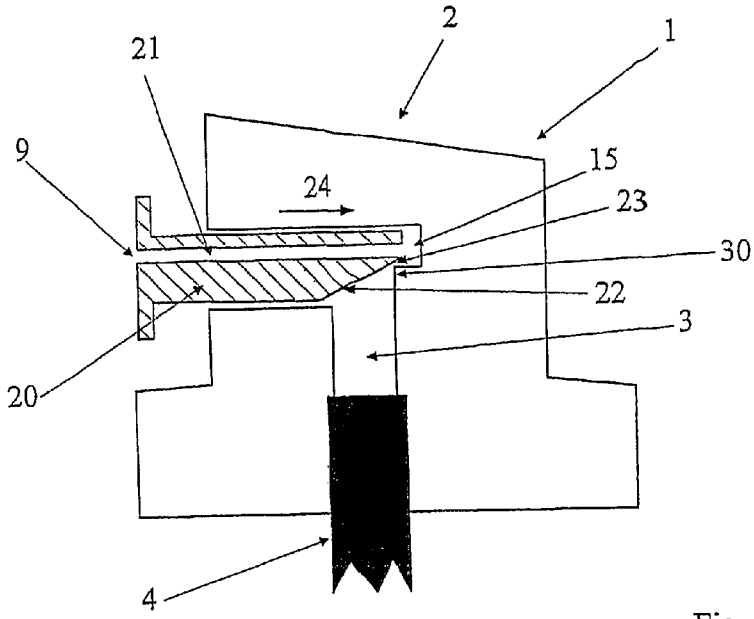
FIG. 5 is a cross-sectional representation of a spray head according to the invention as a fifth embodiment.

In the embodiment of the invention as shown in FIG. 5 spray head °1 has been provided with a lateral bore 15 arranged transversely to axial bore 3 but said lateral bore being open at the outlet side only. At the side facing the closed end of lateral bore °15 axial bore 3 has been provided with a projection 30 extending into said lateral bore. A tubular element °20 is inserted into lateral bore 15 said element being provided with a bevel °22 which is located at its inner end and points to axial bore °3. Between projection 30 and bevel 22 a flow passage 23 is created which opens to an ever increasing degree reflecting the position of tubular element 20 being pulled out of lateral bore 15. In this case there is a direct connection available for the aerosol product to be sprayed extending from axial bore 3, flow passage 23, lateral bore 15 to passage 21 in tubular element 20 and finally to outlet 9. When tubular element 20 is moved inwards in the direction shown by arrow 24 the distance between bevel 22 and projection 30 becomes smaller so that the flow passage 23 closes to an increasing degree until the discharge rate of the aerosol product is reduced correspondingly to the desired value.

Figure 6:
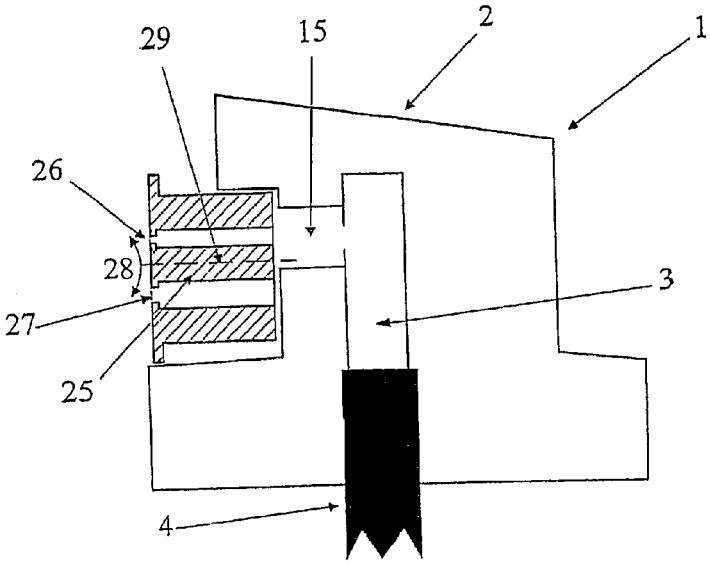
FIG. 6 is a cross-sectional representation of a spray head according to the invention as a sixth embodiment.

In accordance with the embodiment of the invention illustrated in FIG. 6 a rotatable element 25 equipped with nozzles 26 and 27 is arranged in the outlet area of lateral bore 15 provided to bring about the connection to axial bore 3. The representation of the rotatable element 25 consisting of three individual parts as shown here is merely intended to elucidate the outlet channels; in actual fact, this is a single component which has been denoted by the respective broken lines. The rotatable element 25 can be turned around axis 29 as shown by arrow 28 in such a manner that either nozzle 26 having a small flow passage or nozzle 27 provided with a larger passage opening is positioned in front of the lateral bore 15 which results in the discharge rate being changed.

Figure 7:
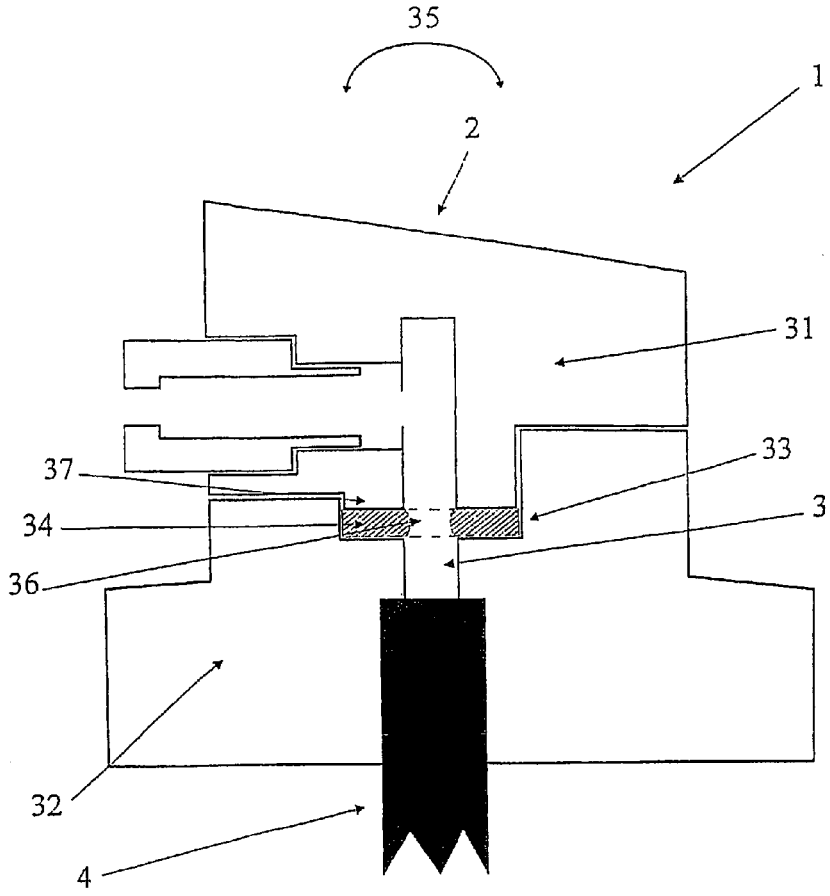
FIG. 7 is a cross-sectional representation of a spray head according to the invention as a seventh embodiment.

Another embodiment of the invention is shown in FIG. 7 said embodiment providing for spray head 1 consisting of a top part 31 and a bottom part 32. In bottom part 32 a circular recess 33 has been provided through the center of which axial bore 3 extends. An elastic element 34 is fitted into the circular recess 33 arranged in bottom part 32 said element having the shape of a ring with a bore 36 located in its center which with respect to its diameter coincides with axial bore 3. Top part 31 and bottom part 32 are joined with the help of a fine-pitch thread. By turning the top part 31 and bottom part 32 counter to each other in the direction of arrow 35 top part 31 and bottom part 32 can be moved towards or away from each other.

At the location where the circular recess 33 is situated in bottom part 32 top part 31 has been provided with a projection 37 which extends into recess 33. If the distance between top part 31 and bottom part 32 is reduced by performing a rotational movement in the direction shown by arrow 35 the projection 37 moves deeper into the circular recess 33 thus compressing the elastic element 34 in the direction parallel to axial bore 3. At the same time the elastic element 34 expands transversely to the direction of axial bore 3 as a result of the pressure thus exerted. The elastic element 34 which is virtually non-compressible can only give way and thus widen in the direction of the axial bore 3 which causes the diameter of the bore 36 existing in the elastic element 34 to become smaller which in turn results in the cross-sectional area of the axial bore 3 to diminish as well. Reducing the cross section in this manner will bring about a reduction of the discharge rate of the spray head. If the top part 31 is rotated in the opposite direction 35 in relation to the bottom part 32 of the spray head 1 the distance between the top part 31 and bottom part 32 becomes greater which causes the elastic element 34 to be decompressed accordingly. The diameter of bore 36 becomes larger until the original diameter is attained and the discharge rate increases.

The invention claimed is:

1. A spray head, wherein the spray head serves to deliver a material to be sprayed into the surroundings, the spray head comprising:

an axial bore, through which the material to be sprayed is conducted into the spray head, an adjustment device to regulate spray head discharge rate, comprising a rotatable, cylindrical element with a first end and a second end, and a lateral bore situated in the spray head transverse to and in communication with the axial bore, the lateral bore extending through the spray head and comprising two ends and a longitudinal axis passing through the two ends, with an outlet of the spray head being located at one of the two ends and the cylindrical element projecting into the lateral bore from the other end, wherein the first end of the cylindrical element extends over the axial bore, the cylindrical element having a bevel or rounding at the first end when viewed in a cross-section through the longitudinal axis of the lateral bore, the bevel or rounding enabling a flow passage to be cleared extending from the axial to the lateral bore when the bevel or rounding is positioned over the axial bore upon turning the cylindrical element, the flow passage being external to the cylindrical element, whereas further rotating or turning the cylindrical element causes a non-beveled or non-rounded portion of the first end to be positioned over the axial bore, wherein the bevel or rounding is shaped such that the spray head discharge rate is regulated in a variable manner, with a maximum discharge rate being attained when a portion of the bevel or rounding is positioned over the axial bore, and a minimum discharge rate is achieved by covering the axial bore with the non-beveled or non-rounded portion of the cylindrical element, and wherein the second end of the cylindrical element projects from the spray head on a side opposite to the outlet such that turning the second end results in a desired spray head discharge rate.

2. The spray head of claim 1, wherein the size of the flow passage is controlled by rotation of the cylindrical element around the longitudinal axis.

* * * * *